United States Patent [19]

Wang et al.

[11] 4,386,864

[45] Jun. 7, 1983

[54] SELECTIVE PAPER INSERTION AND FEEDING MEANS FOR INDIVIDUAL SHEET PRINTING APPARATUS

[75] Inventors: An Wang, Lincoln; Gerald J. Crean, Topsfield, both of Mass.

[73] Assignee: Wang Laboratories, Inc., Lowell, Mass.

[21] Appl. No.: 204,020

[22] Filed: Nov. 4, 1980

[51] Int. Cl.[3] ..... B41J 13/10

[52] U.S. Cl. ..... 400/625; 400/144.2; 400/175; 400/196.1; 400/208; 400/629; 400/637.2; 400/639.2; 400/691; 400/708; 271/3; 271/65; 271/DIG. 9; 271/279

[58] Field of Search ..... 400/55, 59, 144.2, 144.3, 400/144.4, 171, 174, 175, 196, 196.1, 208, 550, 624, 625, 629, 637.1, 639.2, 690, 690.1, 690.2, 690.3, 690.4, 691, 692, 693, 708, 708.1; 271/3, 3.1, 4, 65, 279, 300, 302, DIG. 9

[56] References Cited

U.S. PATENT DOCUMENTS

| | | | |
|---|---|---|---|
| 2,901,246 | 8/1959 | Wagner | 271/3 |
| 3,337,213 | 8/1967 | La Barre | 271/3 |
| 4,113,244 | 9/1978 | Ruenzi | 271/4 |
| 4,164,649 | 8/1979 | Anderegg et al. | 271/4 X |
| 4,208,666 | 6/1980 | Paranjpe | 271/4 X |
| 4,212,456 | 7/1980 | Ruenzi | 271/4 |
| 4,262,894 | 4/1981 | Marano | 271/4 |
| 4,266,880 | 5/1981 | Buchanan | 400/550 |
| 4,268,021 | 5/1981 | Rutishauser et al. | 271/4 |
| 4,272,205 | 6/1981 | Bisczat et al. | 400/550 X |
| 4,285,607 | 8/1981 | Steinhilber | 271/4 X |

FOREIGN PATENT DOCUMENTS 2655703 6/1978 Fed. Rep. of Germany ..... 400/625

OTHER PUBLICATIONS

IBM Technical Disclosure Bulletin, "Typewriter Card Feed", Allen et al., vol. 11, No. 11, Apr. 1969, pp. 1419–1420.

*Primary Examiner*—Ernest T. Wright, Jr.

[57] ABSTRACT

Printing apparatus, having a rotatable platen with a printing element in front of it and a reversible platen drive for rotating the platen counterclockwise or clockwise relative to the printing element, is operable to feed, from an upper hopper extending upwardly and rearwardly from the bottom of the platen, an unprinted sheet to the bottom of the platen and forwardly and upwardly to the front of the platen into printing position. A selector switch may be provided for selecting the direction of rotation of the platen after completion of printing so that its rotation counterclockwise moves the printed sheet upwardly and rearwardly toward the upper hopper and its rotation clockwise moves the printed sheet downwardly for sequential stacking in the lower hopper to collate successive printed sheets in their order of printing. A bail switch operable upon movement of the upper platen feed roll away from the platen may also be provided to cause the platen to rotate counterclockwise to move the leading edge of the unprinted sheet into printing position.

6 Claims, 12 Drawing Figures

FIG 1
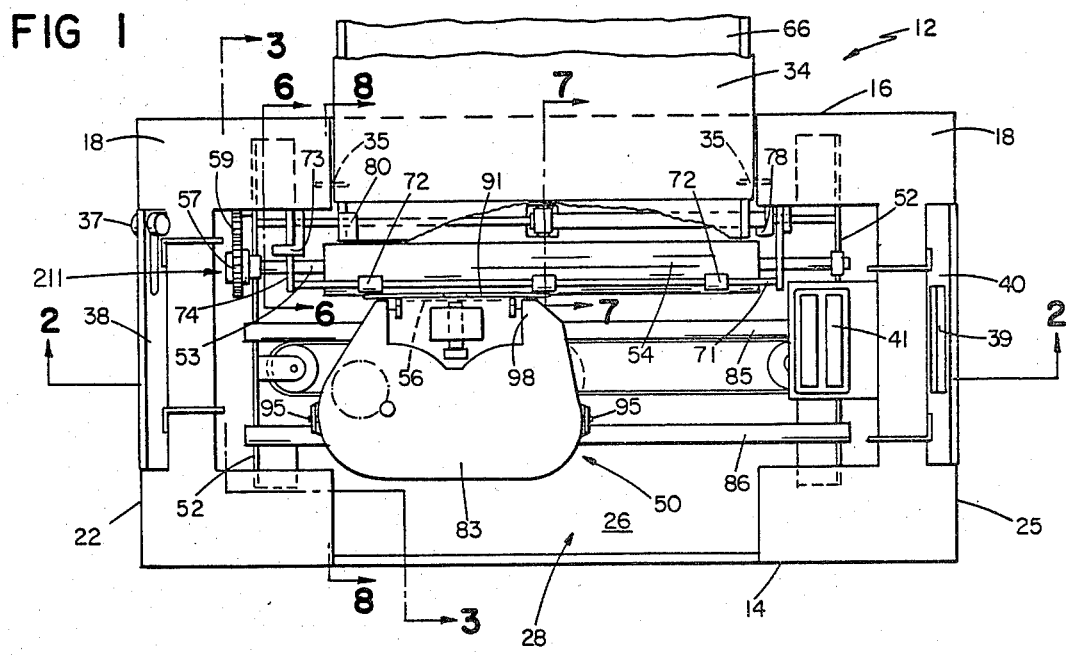
FIG 10
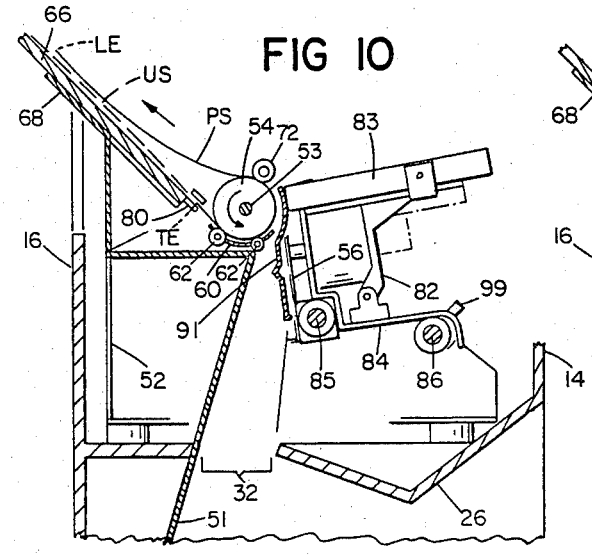
FIG 11
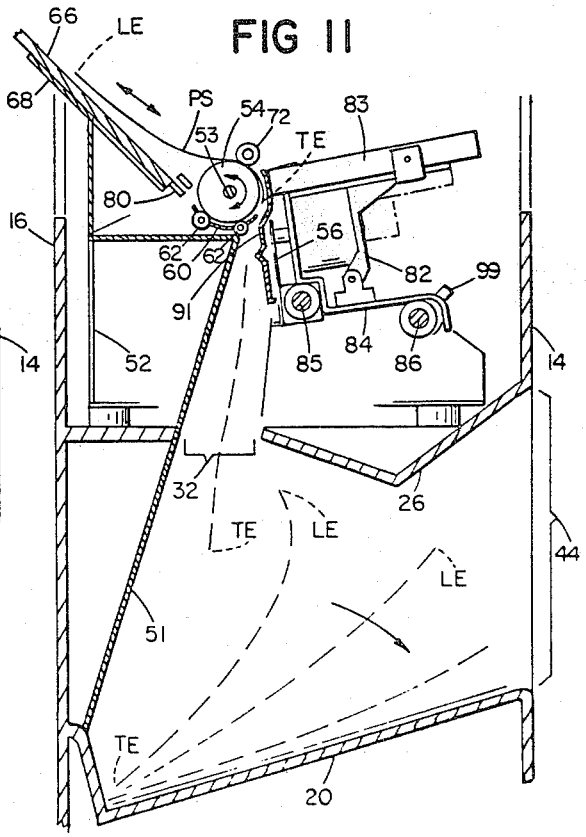
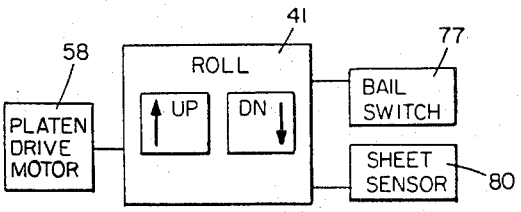
FIG 12

SELECTIVE PAPER INSERTION AND FEEDING MEANS FOR INDIVIDUAL SHEET PRINTING APPARATUS

This invention relates to printers and, more particularly, to high speed printers such as are used in conjunction with word processing computer systems and the like.

It is particularly desirable that a high speed printer for a word processing computer system be capable of automatically feeding and moving into printing position individual sheets of paper to be printed and, after printing, collating and stacking the multiple printed sheets of the document in their proper sequence, and to do so with a minimum of operator intervention. It is also desirable that the operator be able easily to change such individual sheet handling printers from a multiple sheet document collating mode of operation to a more convenient mode for handling single printed sheet documents.

Printers in the prior art are deficient in these respects, primarily in that they lack automatic collation mechanisms which are simple and composed of few parts. One such device, for example, contains sheet turning means having deflector blades, a curved pocket and a leaf spring, as disclosed in Wagner, U.S. Pat. No. 2,901,246. Another device employs an arcuate guide and a resilient restraining member, as disclosed in LaBarre, U.S. Pat. No. 3,337,213. Now can such devices be readily changed to a different mode of operation more convenient for the production of single sheet documents.

A further disadvantage of such prior art printers is the requirement that the operator manipulate several mechanisms in sequence in order to move a sheet into printing position.

In view of such deficiencies of the prior art, it is a major object of the present invention to provide a novel printing apparatus capable of collating and stacking the multiple printed sheets of a document in their proper sequence, and to do so with a minimum of operator intervention.

It is another object of the present invention to provide a novel printing apparatus which the operator can easily change from a multiple sheet document collating mode of operation to a more convenient mode for handling single printed sheet documents.

The above and still further objects of the present invention are provided by a novel individual sheet printing apparatus, having a rotatable platen with a printing element in front of it and a reversible platen drive for rotating the platen, which is operable to feed, from an upper hopper extending upwardly and rearwardly from the bottom of the platen, an unprinted sheet to the bottom of the platen and forwardly and upwardly to the front of the platen into printing position. A selector switch may be provided for selecting the direction of rotation of the platen after completion of printing to cause the platen to rotate about its axis in one sense and move a printed sheet upwardly and rearwardly toward the upper hopper or alternatively to cause the platen to rotate in the opposite sense to move a printed sheet downwardly for sequential stacking in the lower hopper to collate successive printed sheets in their order of printing. A bail switch may also be provided to cause the platen to rotate in said one sense to move the leading edge of the sheet into printing position.

For the purpose of more fully explaining the above and still further objects and features of the invention, reference is now made to the following detailed description of a preferred embodiment thereof, taken together with the accompanying drawing, wherein:

FIG. 1 is a top view of the printing apparatus of the present invention;

FIGS. 10 and 11 are diagrammatic side cross section views of the printing apparatus of FIG. 1, illustrating its operation; and FIG. 12 is a simplified circuit diagram of the printing apparatus of FIG. 1.

Figure 2:
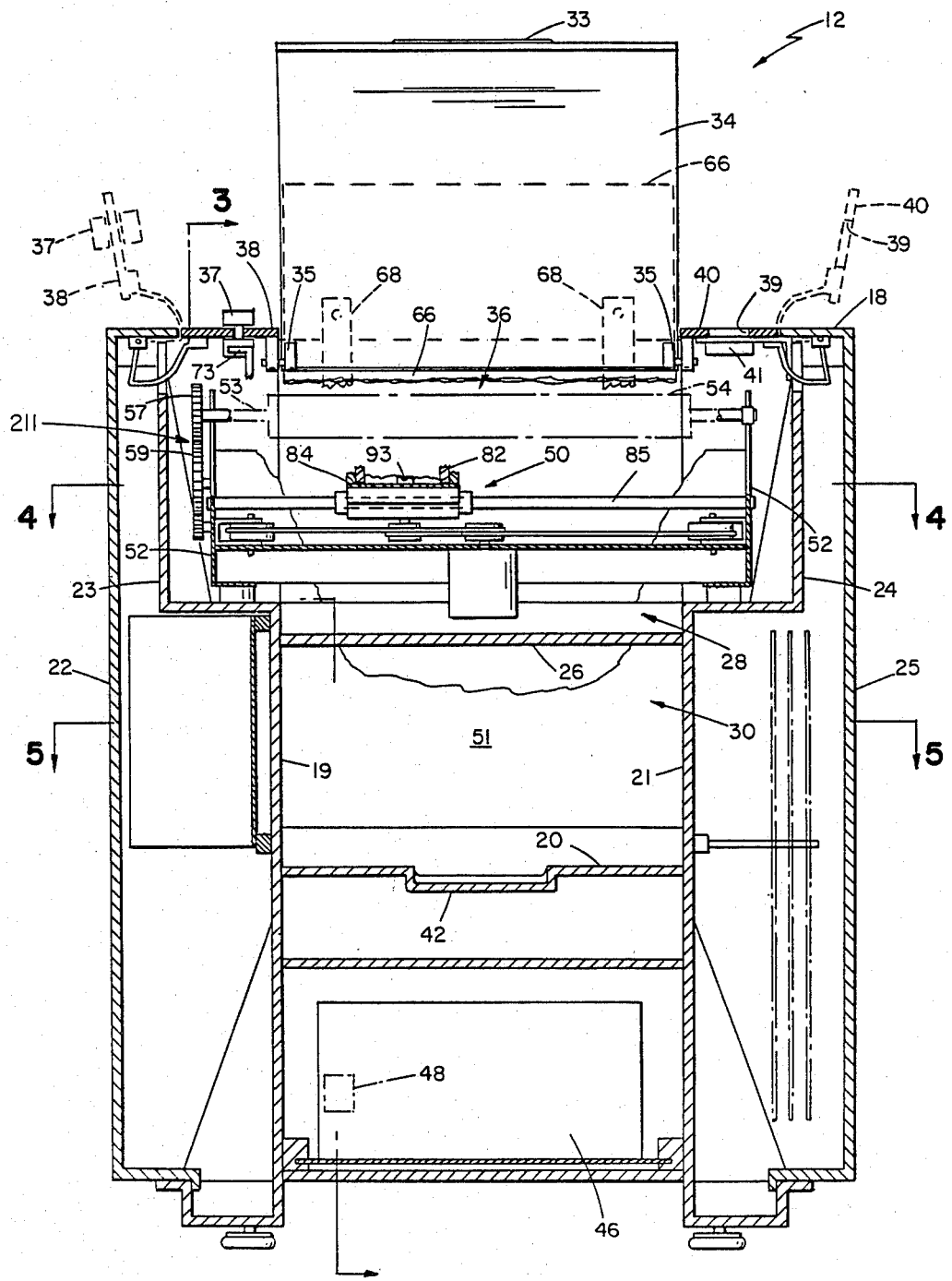
FIG. 2 is a front vertical cross section view of the printing apparatus of FIG. 1, taken along line 2—2 of FIG. 1.

Referring to the drawing, the printing apparatus of the present invention, generally designated 12, is best shown in FIGS. 1, 2, 3, 4 and 5. Printing apparatus 12, which is preferably selectively operable in either a single sheet delivery mode or a multiple sheet collating mode, comprises a front wall 14, a rear wall 16, a top wall 18, a bottom wall 20, side walls 22 and 25, and a generally horizontal center wall 26 which defines two vertically spaced chambers 28 and 30. A printing mechanism, generally designated 50, is received within upper chamber 28.

Figure 3:
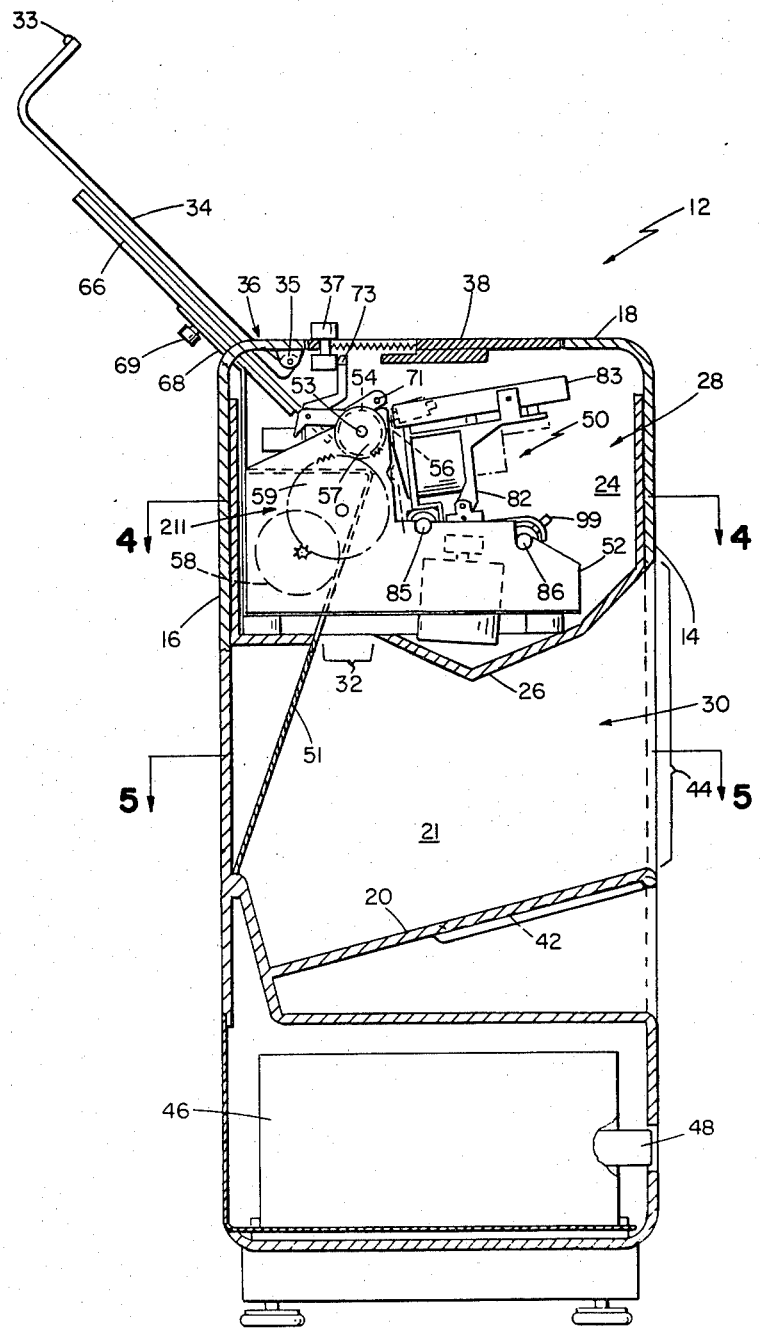
FIG. 3 is a side vertical cross section view of the printing apparatus of FIG. 1, taken along line 3—3 of FIGS. 1 and 2.
Figure 4:
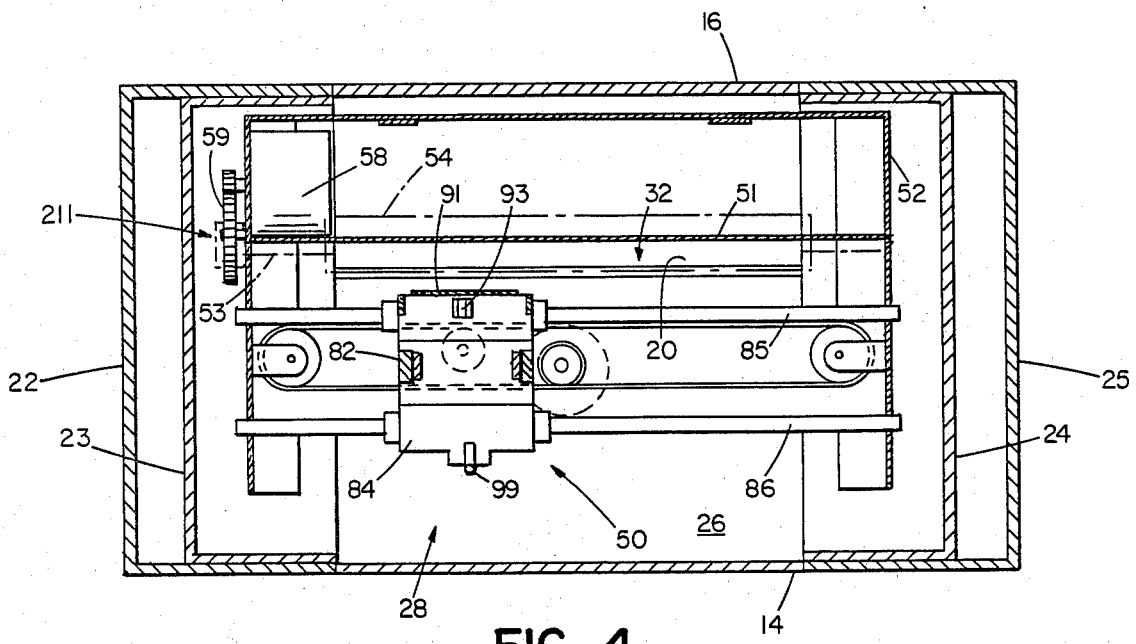
FIG. 4 is a horizontal cross section view of the printing apparatus of FIG. 1, taken along line 4—4 of FIGS. 2 and 3.

More specifically, upper inner opposed side walls 23 and 24 and generally horizontal center wall 26 together define upper chamber 28, as best shown in FIGS. 2, 3 and 4, which has a configuration adapted to receive printing mechanism 50. Center wall 26, as shown in FIGS. 3 and 4, includes a narrow elongated opening 32 which is adjacent to and extends along rear wall 16. Narrow opening 32 allows communication between upper chamber 28 and lower chamber 30.

Top wall 18 has a wide central cover portion 34 which is pivotally mounted thereon and includes a narrow elongated aperture 36 adjacent and extending along rear wall 16, and two side door portions 38 and 40 each of which is pivotally mounted on outer side walls 22 and 25, respectively. Top cover 34, as best shown in its open position in FIGS. 2 and 3, and side door portions 38 and 40, as shown in their open positions in FIG. 2 by dotted lines, provide easy access to printing mechanism 50 for maintenance thereof.

More specifically, top cover 34, which is made of transparent plastic material for allowing viewing of printing mechanism 50, is mounted on hinges 35 at the rear of top wall 18. In addition, top cover 34 has an outwardly protruding detent 33, as best shown in FIGS. 2 and 3, which facilitates easy opening thereof by an operator. Left side door portion 38 includes an operating lever 37 which is used to actuate printing mechanism 50; and right side door portion 40 includes an opening 39 which allows an operator access to pushbutton selector switches 41, as best shown in FIGS. 1, 2 and 12.

Bottom wall 20, rear wall 16, and lower inner opposed side walls 19 and 21 define lower chamber 30 which is provided as a hopper for receiving printed sheets PS with their printed side down. For facilitating the removal of collated printed sheets PS from lower chamber hopper 30, bottom wall 20 includes a generally downwardly and rearwardly extending recessed central portion 42, as best shown in FIGS. 2, 3 and 5.

Figure 5:
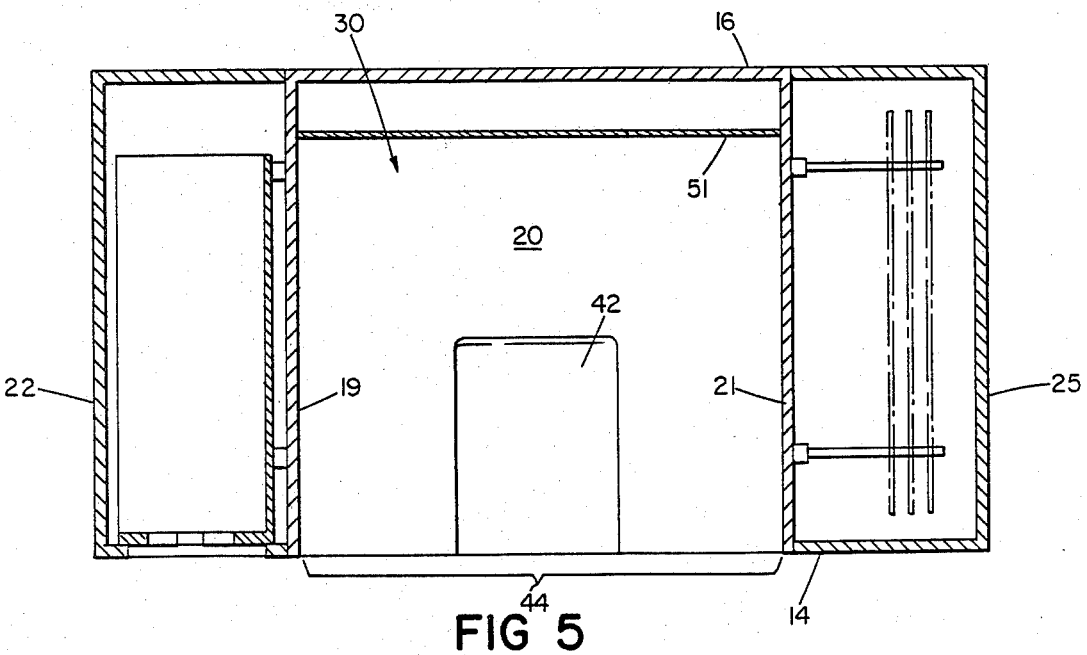
FIG. 5 is a horizontal cross section view of the printing apparatus of FIG. 1, taken along line 5—5 of FIGS. 2 and 3.

Front wall 14 includes an aperture 44 which provides easy access to lower chamber hopper 30 for removing printed sheets PS, as best shown in FIGS. 3 and 5. Printing apparatus power supply 46 is mounted below lower chamber 30, as shown in FIGS. 2 and 3. Power switch 48 is provided on the front side of power supply 46.

According to the present invention, printing mechanism 50, as best shown in FIGS. 1, 2, 3, 4, 8 and 9, comprises a frame 52 which is removably mounted within upper chamber 28, a rotatable platen 54 mounted on frame 52, and a "daisy" rotary print wheel or printing element 56 rotatably mounted on print head 82 adjacent the front of platen 54 for printing on individual sheets interposed between platen 54 and printing element 56.

More specifically, a reversible platen drive mechanism 211, best shown in FIGS. 1, 2, 3 and 4, is mounted on frame 52 for selectively rotating platen 54 about its axis in a direction moving the surface of the platen nearest print wheel 56 upwardly or downwardly relative to rotary print wheel 56. The platen drive mechanism includes a reversible platen drive motor 58, which drives gears 57 and 59 which in turn rotate platen shaft 53 having platen 54 mounted thereon.

Figure 7:
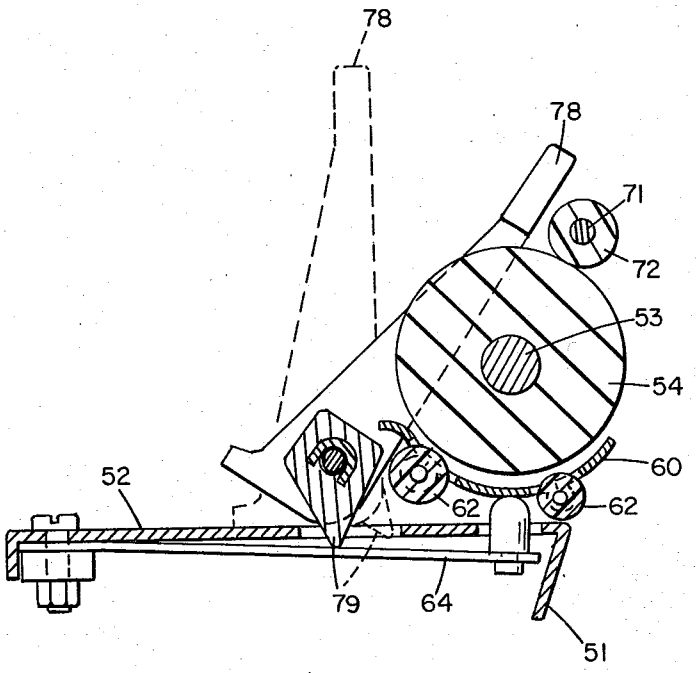
FIG. 7 is an enlarged cross section view of the printing apparatus of FIG. 1, taken along line 7—7 of FIG. 1.

Lower platen feed roll and guide mechanism, as best shown in FIGS. 6, 7, 8 and 9, mounted on frame 52 adjacent the bottom of platen 54, is provided to cooperate with platen 54 for feeding an unprinted sheet US from the bottom of platen 54 upwardly and forwardly to the front of platen 54. The lower platen feed roll and guide mechanism includes an arcuate feed guide 60 having a plurality of feed rollers 62 rotatably mounted thereon. A leaf spring 64 mounted on frame 52 normally urges feed guide 60 in an upward direction to maintain contact between rollers 62 and the bottom of platen 54, as best shown in FIG. 7.

A manually operable platen tension release lever 78, pivotally mounted on frame 52 away from drive gears 57 and 59, is provided for disengaging rollers 62 from platen 54, as shown by the dotted lines in FIG. 7. To this end, lower end 79 of tension release lever 78 operates to cam leaf spring 64 downwardly which in turn disengages rollers 62 from platen 54.

An upper hopper plate 66, extending upwardly and rearwardly from the lower platen feed roll and guide mechanism, as best shown in FIGS. 1, 2 and 3, is provided for feeding the unprinted sheet US to lower platen feed rollers 62 and guide 60. Hopper plate 66, which is removably mounted on an upwardly and rearwardly extending metal bracket 68 and secured thereto by screws 69, extends through narrow aperture 36 of transparent top cover 34.

Printed sheet guide plate 51, mounted on frame 52 below platen 54 adjacent rear wall 16, is provided for guiding a printed sheet PS with its printed side down through narrow opening 32 of center wall 26 toward lower chamber hopper 30 to collate successive printed sheets in their order of printing in lower chamber hopper 30, as best shown in FIGS. 2, 3, 5, 8 and 9.

Bail switch and upper platen feed roll mechanism, generally designated 70 and best shown in FIGS. 1, 2, 3, 6 and 7, is provided to operate reversible platen drive motor 58 to rotate platen 54 in the counterclockwise direction to move the unprinted sheet US from upper hopper plate 66 into printing position. A shaft-like bail 71, mounted on frame 52 adjacent the top of platen 54, includes a plurality of upper platen feed rollers 72 rotatably mounted thereon which are normally in contact with platen 54 to feed printed sheet PS upwardly and rearwardly toward upper hopper plate 66. Upper platen feed rollers 72 are arranged to be manually moved from a normal feeding position closely adjacent platen 54 to a sheet inserting position spaced from platen 54, as hereinafter more fully described.

Figure 6:
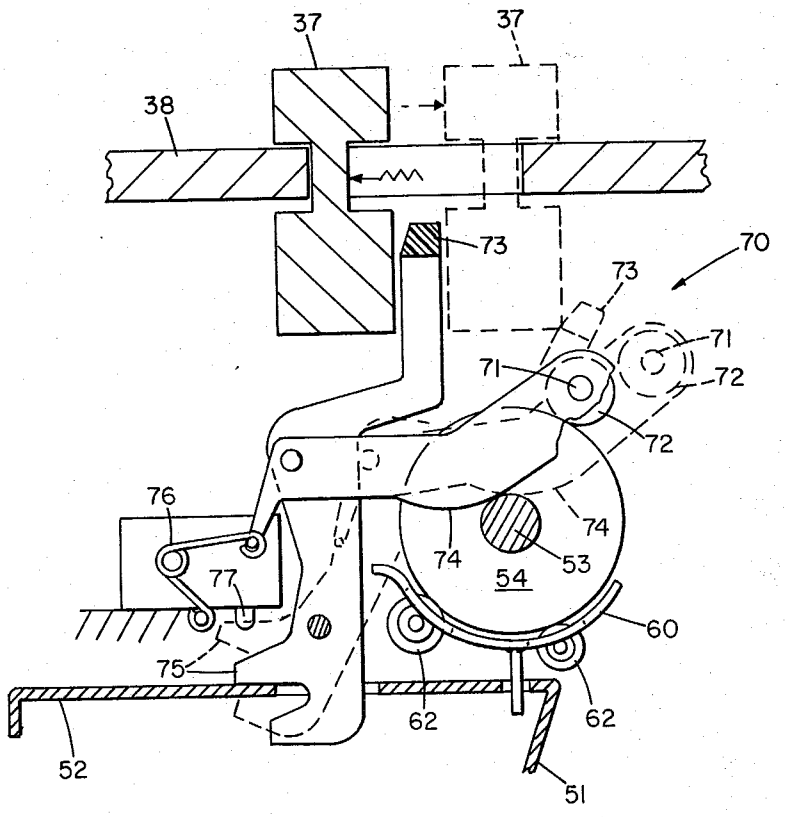
FIG. 6 is an enlarged cross section view of the printing apparatus of FIG. 1, taken along line 6—6 of FIG. 1.

A manually operable upwardly extending bail switch lever 73 and a downwardly extending bail switch actuator 75, pivotally mounted on frame 52, are connected to a bail switch cam 74 having bail 71 mounted thereon, as best shown in FIG. 6. Bail switch lever 73, cam 74, and actuator 75 are normally held in the non-inserting position by spring 76, which in turn also maintains upper platen feed rollers 72 in contact with platen 54. When left side door operating lever 37 is manually moved to contact bail switch lever 73, as shown by dotted lines in FIG. 6, bail switch actuator 75 contacts bail switch 77 which is connected to platen drive motor 58. Bail switch cam 74, camming on platen shaft 53, spaces rollers 72 away from platen 54.

Figure 8:
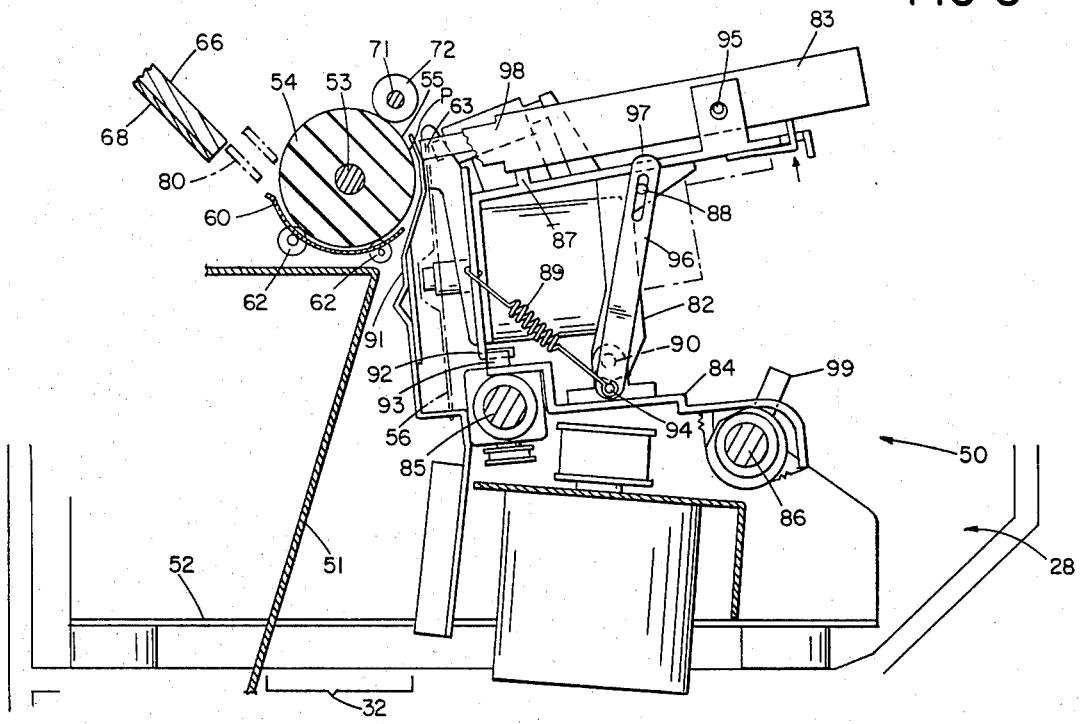
FIG. 8 is an enlarged cross section view of the printing apparatus of FIG. 1, taken along line 8—8 of FIG. 1, showing the print head and ribbon cartridge in operative position.
Figure 9:
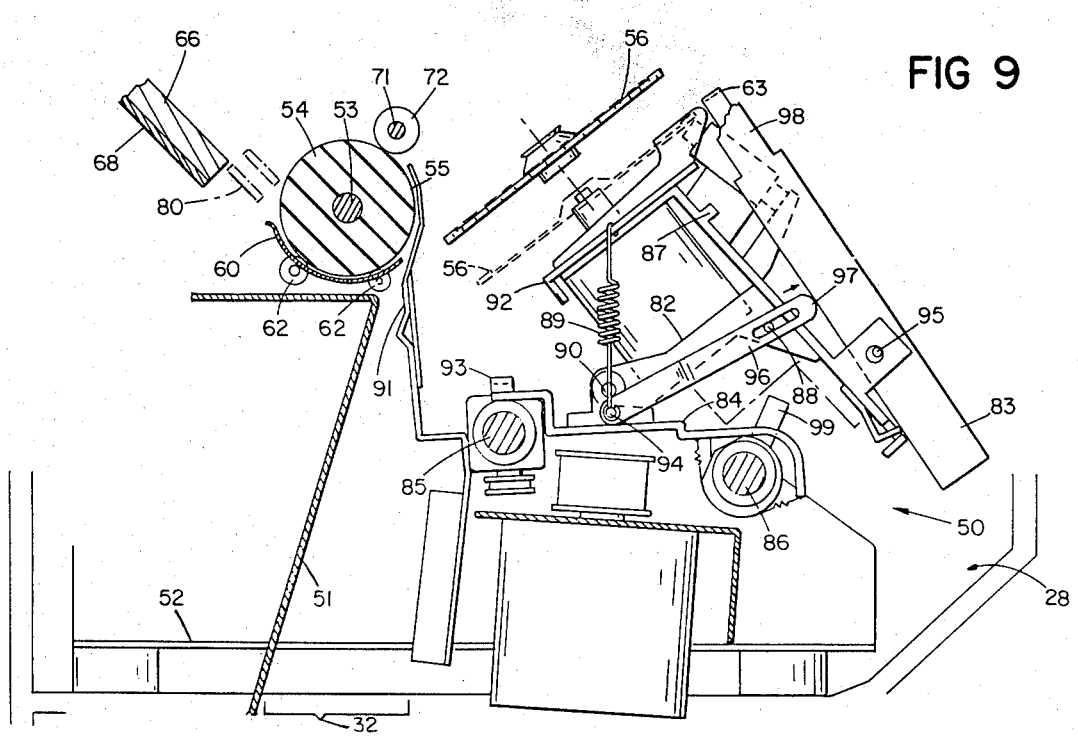
FIG. 9 is an enlarged cross section view of the printing apparatus of FIG. 1, taken along line 8—8 of FIG. 1, showing the print head and ribbon cartridge in tilted inoperative position.

Sheet sensor photocell 80, which is mounted on frame 52 adjacent the lower platen feed roll and guide mechanism and bail switch mechanism 70, as best shown in FIGS. 1, 8 and 9, is provided for sensing the leading edge LE and trailing edge TE of a sheet. Photocell 80 is connected and arranged to operate platen drive motor 58. Selector switches 41, mounted on frame 52 below right side door portion 40, as best shown in FIGS. 1, 2 and 12, are provided for selecting the direction of rotation of platen 54 after completion of printing of the sheet, selector switches 41 being connected and arranged to operate reversible platen drive motor 58.

Photocell 80, upon sensing the leading edge LE of unprinted sheet US from upper hopper plate 66, together with bail switch mechanism 70 upon manual movement of bail switch lever 73 to move rollers 72 away from platen 54, operates platen drive motor 58 before printing to rotate platen 54 in the upward direction to move unprinted sheet US into printing position.

Photocell 80, upon sensing the trailing edge TE of printed sheet PS, together with selector switches 41 upon selection of rotation of platen 54 in the counterclockwise direction UP, operates platen drive motor 58 after printing to move printed sheet PS upwardly and rearwardly toward upper hopper plate 66, as best illustrated in FIG. 10.

Photocell 80, upon sensing the trailing edge TE of printed sheet PS, together with selector switches 41 upon selection of rotation of platen 54 in the clockwise direction DN, operates platen drive motor 58 after printing to move printed sheet PS first upwardly to move the trailing edge TE upwardly above lower platen feed guide 60 and then downwardly for sequential stacking in lower chamber hopper 30, as best illustrated in FIG. 11.

A print head and ribbon cartridge assembly, as best shown in FIGS. 1, 2, 3, 4, 8 and 9, is provided for supporting print head 82 carrying rotary print wheel 56 for tilting movement between its normal position adjacent platen 54 with the rotational axis of rotary print wheel 56 perpendicular to platen 54 and its inoperative position tilted away from platen 54 for removal and replacement of print wheel 56. Print head 82 in turn supports ribbon cartridge 83 thereon for tilting movement from a normal position with its portion 98 adjacent platen 54 in contact with supporting lug 87 on print head 82 into an inoperative position with its portion 98 tilted away from print head 82, so that rotary print wheel 56 may be removed and replaced without removing ribbon cartridge 83.

More specifically, the print head and ribbon cartridge assembly includes assembly base plate 84 movably mounted on support shafts 85 and 86, which are mounted on frame 52, as best shown in FIGS. 1, 2 and 4. The print head and ribbon cartridge assembly is arranged to be moved along a printing line P parallel to the surface of platen 54 conventionally.

Print head 82 has a pivot axis 90 adjacent the bottom of print head 82 and parallel to print line P for mounting it on base plate 84 for tilting the print head and ribbon cartridge assembly into an inoperative position away from platen 54, as shown by FIG. 9. The inoperative position places print wheel 56 tilted approximately 90 degrees away from the operative position adjacent platen 54, as shown in FIG. 8. Print head 82 has a coil spring 89 which normally urges print head 82 to the printing position shown in FIG. 8. Downwardly extending detent 92 is received within socket 93 of base plate 84 for maintaining print head 82 in the printing position shown in FIG. 8.

Ribbon cartridge 83 is pivotally mounted adjacent its end away from platen 54 on top of print head 82 for tilting movement about pivot axis 95 on top of print head 82 and parallel to and spaced from print head pivot axis 90 from its operating position with its portion 98 in contact with supporting lug 87 on print head 82 into an extended inoperative position with its portion 98 tilted away from print head 82 and spaced from lug 87.

An actuating link 96 is provided for tilting ribbon cartridge 83 into its extended inoperative tilted position upon tilting of the print head and ribbon cartridge assembly into its inoperative position. Link 96 has its lower end pivotally mounted on base plate 84 for pivotal movement about its pivot axis 94 and its opposite end 97 contacting ribbon cartridge 83 between ribbon cartridge pivot axis 95 and print wheel 56. Its upper end is retained in position by pin and slot retainer 88.

Link pivot axis 94 is spaced beneath print head pivot axis 90 on the opposite side thereof with respect to ribbon cartridge 83 in normal operating position. The length of actuating link 96 between its pivot axis 94 and the bottom of ribbon cartridge 83 is greater than the distance between print head pivot axis 90 and the bottom of ribbon cartridge 83 but less than the distance between its pivot axis 94 and the bottom of ribbon cartridge 83 in normal operating position, so that in normal operating position, ribbon cartridge portion 98 remains in contact with lug 87 with the ribbon 63 interposed between print wheel 56 and platen 54.

However, upon tilting print head 82 about its pivot axis 90 to its inoperative position, actuating link 96 contacts portion 98 of ribbon cartridge 83 to tilt it progressively away from lug 87 to its extended tilted position in which the length of link 96 is greater than the normal distance between print head pivot axis 90 and the bottom of ribbon cartridge 83, since in such extended operating position, link pivot axis 94 is generally beside, rather than on the opposite side of, print head pivot axis 90 with respect to ribbon cartridge 83. In the extended tilted position of ribbon cartridge 83, its ribbon 63 no longer overlies print wheel 56, so that print wheel 56 can be removed or replaced without interference from the ribbon 63.

The print head and ribbon cartridge assembly further includes a printed sheet deflector guide 91 positioned between platen 54 and print wheel 56 to guide the trailing edge TE of printed sheet PS toward narrow opening 32 of center wall 26, and a form thickness adjustment lever 99 mounted around the periphery of shaft 86 adjacent the rear of base plate 84. Adjustment lever 99 permits the feeding of multiple sheets between platen 54 and deflector guide 91 for simultaneous printing thereof.

In operation, an unprinted sheet US is placed on upper hopper plate 66, its leading edge LE extending through narrow top cover aperture 36 and positioned at the nip formed between platen 54 and lower platen feed guide 60, as best illustrated by the dotted lines in FIG. 10. Left side door operating lever 37 is then manually moved forward to actuate bail switch and upper platen feed roll mechanism 70, as best illustrated in FIG. 6. Photocell 80, having sensed the leading edge LE of unprinted sheet US, together with the manual movement of bail switch lever 73 to move rollers 72 away from platen 54 operates platen drive motor 58 to rotate platen 54 in the upward direction to move unprinted sheet US into printing position. Operating lever 37 is then returned to its normal feeding position with feed rollers 72 closely adjacent platen 54. If unprinted sheet US is improperly aligned or skewed, manually operable platen tension release lever 78 may be used to disengage lower platen feed rollers 62 from platen 54 in order to re-align unprinted sheet US.

When printing has been completed, selector switches 41 are actuated to select either the single sheet delivery mode by actuating switch 41UP or the multiple sheet collating mode by actuating switch 41DN, as best shown in FIG. 12. If the single sheet delivery mode is selected, photocell 80, upon sensing the trailing edge TE of printed sheet PS together with the selection of this mode, operates platen drive motor 58 to rotate platen 54 counterclockwise to move printed sheet PS upwardly and rearwardly toward upper hopper plate 66, as best shown in FIG. 10. If the multiple sheet collating mode is selected, photocell 80, upon sensing the trailing edge TE of printed sheet PS together with the selection of this mode, operates platen drive motor 58 to move printed sheet PS first upwardly to move the trailing edge TE upwardly above lower platen feed guide 60 and then downwardly for sequential stacking in lower chamber hopper 30, as best shown in FIG. 11.

During the downward movement of the collation mode, printed sheet deflector guide 91 positioned between platen 54 and print wheel 56 guides the trailing edge TE of printed sheet PS toward narrow opening 32 of center wall 26 to prevent the trailing edge TE from being caught on print wheel 56, as best shown in FIG. 11. Printed sheet guide plate 51 then guides printed sheet PS with its printed side down through narrow opening 32 of center wall 26 toward lower chamber hopper 30 to collate successive printed sheets PS of a multiple sheet document in their order of printing in lower chamber hopper 30, as best shown by the dotted lines in FIG. 11. Front wall aperture 44 provides easy access to the collated printed sheets PS in lower chamber hopper 30; and the generally downwardly and rearwardly extending recessed central portion 42 facilitates the removal of the stacked and collated printed sheets PS.

During maintenance or adjustment of printing mechanism 50, top cover 34 and side door portions 38 and 40 are opened to provide easy access thereto. Top cover 34, using detent 33, is pivoted back to lie atop upper hopper plate 66, as best shown by FIGS. 2 and 3. Platen 54 and lower platen feed guide 60 and feed rollers 62 may be readily removed from frame 52 for servicing.

The print head and ribbon cartridge assembly may be tilted into the inoperative position for easy access to rotary print wheel 56 without having to remove ribbon cartridge 83. The inoperative position places print wheel 56 approximately 90 degrees away from the operative position adjacent platen 54, as best shown in FIG. 9. Actuating link 96 then tilts portion 98 of ribbon cartridge 83 into the extended tilted position to facilitate the removal of print wheel 56 free from interference from either platen 54 or ribbon cartridge 83.

Various modifications of the invention, such as the use of alternative sheet supporting surfaces, within the spirit of the invention and the scope of the appended claims, will occur to those skilled in the printing apparatus art.

What is claimed is:

1. Individual sheet printing apparatus operable in a multiple sheet collating mode, comprising front, rear, top, bottom, and side walls and a generally horizontal center wall defining an upper and a lower vertically spaced chamber, and printing mechanism received within said upper of said vertically spaced chambers, said generally horizontal center wall having a configuration for receiving said printing mechanism, with a narrow opening adjacent said rear wall extending therealong communicating with the lower of said vertically spaced chambers, said top wall having a wide central portion removably mounted thereon providing a narrow aperture adjacent said rear wall extending therealong and two side portions each removably mounted on one of said side walls, said central portion and said side portions providing access to said printing mechanism mounted within said upper chamber, said central portion being of transparent plastic material providing viewing of said printing mechanism, said bottom wall having a generally downwardly and rearwardly extending central portion defining one of the walls of said lower chamber and providing lower chamber hopper means for receiving printed sheets, said front wall having an aperture providing access to said lower chamber hopper means, and said printing mechanism comprising a frame removably mounted within said upper chamber, a rotatable platen mounted on said frame, a printing element mounted on said frame adjacent the front of said platen for printing on individual sheets interposed between said platen and said printing element, reversible platen drive means for rotating a front surface of said platen in a direction upwardly or downwardly relative to said printing element, lower platen feed roll means adjacent the bottom of said platen cooperating with said platen for feeding an unprinted sheet from the bottom of said platen upwardly and forwardly to the front of said platen, upper hopper means extending upwardly and rearwardly from said lower platen feed roll means through said narrow aperture of said transparent top wall central portion for feeding said unprinted sheet to said lower platen feed roll means and said platen, upper platen feed roll means adjacent the top of said platen cooperating with said platen for feeding a printed sheet rearwardly toward said upper hopper means, and printed sheet guide means for guiding a printed sheet with its printed side down through said narrow opening of said horizontal center wall toward said lower chamber hopper means to collate successive printed sheets in their order of printing in said lower chamber hopper means said platen drive means after completion of printing of a sheet rotating said platen front surface in said downward direction to move said printed sheet downwardly for sequential stacking in said lower chamber hopper means.

2. Individual sheet printing apparatus selectively operable in a single sheet delivery mode or a multiple sheet collating mode, comprising front, rear, top, bottom, and side walls and a generally horizontal center wall defining two vertically spaced chambers, and printing mechanism received within an upper one of said vertically spaced chambers, said generally horizontal center wall having a configuration for receiving said printing mechanism, with a narrow opening adjacent said rear wall extending therealong communicating with a lower one of said vertically spaced chambers, said top wall having a wide central portion removably mounted thereon providing a narrow aperture adjacent said rear wall extending therealong and two side portions each removably mounted on one of said side walls, said central portion and said side portions providing access to said printing mechanism mounted within said upper chamber, said central portion being of transparent plastic material providing viewing of said printing mechanism, said bottom wall having a generally downwardly and rearwardly extending central portion defining one of the walls of said lower chamber and providing lower chamber hopper means for receiving printed sheets, said front wall having an aperture providing access to said lower chamber hopper means, and said printing mechanism comprising a frame removably mounted within said upper chamber, a rotatable platen mounted on said frame, a printing element mounted on said frame adjacent the front of said platen for printing on individual sheets interposed between said platen and said printing element, reversible platen drive means for selectively rotating a front surface of said platen in a direction upwardly or downwardly relative to said printing element, lower platen feed roll means adjacent the bottom of said platen cooperating with said platen for feeding an unprinted sheet from the bottom of said platen upwardly and forwardly to the front of said platen, upper hopper means extending upwardly and rearwardly from said lower platen feed roll means through said narrow aperture of said transparent top wall central portion for feeding said unprinted sheet to said lower platen feed roll means and said platen, upper platen feed roll means adjacent the top of said platen cooperating with said platen for feeding a printed sheet rearwardly toward said upper hopper means printed sheet guide means for guiding a printed sheet with its printed side down through said narrow opening of said horizontal center wall toward said lower chamber hopper means to collate successive printed sheets in their order of printing in said lower chamber hopper means, and selector switch means connected to said platen drive means for selecting the direction of rotation of said platen after completion of printing of a sheet, whereby rotation of said platen front surface in said upward direction moves said printed sheet upwardly and rearwardly toward said upper hopper means, and rotation of said platen front surface in said downward direction moves said printed sheet downwardly for sequential stacking in said lower chamber hopper means.

3. The printing apparatus as claimed in claim 1 or 2, further including bail switch means connected to said platen drive means and operable upon manual movement of said upper platen feed roll means away from said platen to cause said platen front surface to rotate in said upward direction to move a leading edge of an unprinted sheet into printing position.

4. Individual sheet printing apparatus operable in a multiple sheet collating mode, comprising front, rear, top, bottom, and side walls and a generally horizontal center wall defining two vertically spaced chambers, and printing mechanism received within an upper one of said vertically spaced chambers, said generally horizontal center wall having a configuration for receiving said printing mechanism, with a narrow opening adjacent said rear wall extending therealong communicating with a lower one of said vertically spaced chambers, said top wall having a wide central portion removably mounted thereon providing a narrow aperture adjacent said rear wall extending therealong and two side portions each removably mounted on one of said side walls, said central portion and said side portions providing access to said printing mechanism mounted within said upper chamber, said central portion being of transparent plastic material providing viewing of said printing mechanism, said bottom wall having a generally downwardly and rearwardly extending central portion defining one of the walls of said lower chamber and providing lower chamber hopper means for receiving printed sheets, said front wall having an aperture providing access to said lower chamber hopper means, and said printing mechanism comprising a frame removably mounted within said upper chamber, a rotatable platen mounted on said frame, a printing element mounted on said frame adjacent the front of said platen for printing on individual sheets interposed between said platen and said printing element, reversible platen drive means for rotating a front surface of said platen in a direction upwardly or downwardly relative to said printing element, lower platen feed roll and guide means adjacent the bottom of said platen cooperating with said platen for feeding an unprinted sheet from the bottom of said platen upwardly and forwardly to the front of said platen, upper hopper means extending upwardly and rearwardly from said lower platen feed roll and guide means through said narrow aperture of said transparent top wall central portion for feeding said unprinted sheet to said lower platen feed roll and guide means and said platen, upper platen feed roll means mounted on said frame adjacent the top of said platen cooperating with said platen for feeding a printed sheet rearwardly toward said upper hopper means printed sheet guide means for guiding a printed sheet with its printed side down through said narrow opening of said horizontal center wall toward said lower chamber hopper means to collate successive printed sheets in their order of printing in said lower chamber hopper means, and sheet sensing means connected to said platen drive means for sensing a trailing edge of a sheet, said sheet sensing means upon sensing a trailing edge of said printed sheet operating said platen drive means after printing to move a printed sheet first upwardly to move its trailing edge upwardly above said lower platen feed roll and guide means and then downwardly for sequential stacking in said lower chamber hopper means.

5. Individual sheet printing apparatus operable in a multiple sheet collating mode, comprising front, rear, top, bottom, and side walls and a generally horizontal center wall defining two vertically spaced chambers, and printing mechanism received within an upper one of said vertically spaced chambers, said generally horizontal center wall having a configuration for receiving said printing mechanism, with a narrow opening adjacent said rear wall extending therealong communicating with a lower one of said vertically spaced chambers, said top wall having a wide central portion removably mounted thereon providing a narrow aperture adjacent said rear wall extending therealong and two side portions each removably mounted on one of said side walls, said central portion and said side portions providing access to said printing mechanism mounted within said upper chamber, said central portion being of transparent plastic material providing viewing of said printing mechanism, said bottom wall having a generally downwardly and rearwardly extending central portion defining one of the walls of said lower chamber and providing lower chamber hopper means for receiving printed sheets, said front wall having an aperture providing access to said lower chamber hopper means, and said printing mechanism comprising a frame removably mounted within said upper chamber, a rotatable platen mounted on said frame, a printing element mounted on said frame adjacent the front of said platen for printing on individual sheets interposed between said platen and said printing element, reversible platen drive means for rotating a front surface of said platen in a direction upwardly or downwardly relative to said printing element, lower platen feed roll and guide means adjacent the bottom of said platen cooperating with said platen for feeding an unprinted sheet from the bottom of said platen upwardly and forwardly to the front of said platen, upper hopper means extending upwardly and rearwardly from said lower platen feed roll and guide means through said narrow aperture of said transparent top wall central portion for feeding said unprinted sheet to said lower platen feed roll and guide means and said platen, upper platen feed roll means mounted on said frame adjacent the top of said platen cooperating with said platen for feeding a printed sheet rearwardly toward said upper hopper means, said upper platen feed roll means being manually movable from a normal feeding position closely adjacent said platen to a sheet inserting position spaced from said platen, printed sheet guide means for guiding a printed sheet with its printed side down through said narrow opening of said horizontal center wall toward said lower chamber hopper means to collate successive printed sheets in their order of printing in said lower chamber hopper means sheet sensing means connected to said platen drive means for sensing leading and trailing edges of a sheet, bail switch means connected to said platen drive means and operable upon manual movement of said upper platen feed roll means, said sheet sensing means upon sensing a leading edge of an unprinted sheet from said upper hopper means together with said bail switch means upon movement of said upper platen feed roll means away from said platen operating said platen drive means before printing to rotate said platen front surface in said upward direction to move said unprinted sheet into printing position, and said sheet sensing means upon sensing a trailing edge of a printed sheet operating said platen drive means after printing to move said printed sheet first upwardly to move a trailing edge upwardly above said lower platen feed roll and guide means and then downwardly for sequential stacking in said lower chamber hopper means.

6. Individual sheet printing apparatus selectively operable in a single sheet delivery mode or a multiple sheet collating mode, comprising front, rear, top, bottom, and side walls and a generally horizontal center wall defining two vertically spaced chambers, and printing mechanism received within an upper one of said vertically spaced chambers, said generally horizontal center wall having a configuration for receiving said printing mechanism, with a narrow opening adjacent said rear wall extending therealong communicating with a lower one of said vertically spaced chambers, said top wall having a wide central portion removably mounted thereon providing a narrow aperture adjacent said rear wall extending therealong and two side portions each removably mounted on one of said side walls, said central portion and said side portions providing access to said printing mechanism mounted within said upper chamber, said central portion being of transparent plastic material providing viewing of said printing mechanism, said bottom wall having a generally downwardly and rearwardly extending central portion defining one of the walls of said lower chamber and providing lower chamber hopper means for receiving printed sheets, said front wall having an aperture providing access to said lower chamber hopper means, and said printing mechanism comprising a frame removably mounted within said upper chamber, a rotatable platen mounted on said frame, a printing element mounted on said frame adjacent the front of said platen for printing on individual sheets interposed between said platen and said printing element, reversible platen drive means for selectively rotating a front surface of said platen in a direction upwardly or downwardly relative to said printing element, lower platen feed roll and guide means adjacent the bottom of said platen cooperating with said platen for feeding an unprinted sheet from the bottom of said platen upwardly and forwardly to the front of said platen, upper hopper means extending upwardly and rearwardly from said lower platen feed roll and guide means through said narrow aperture of said transparent top wall central portion for feeding said unprinted sheet to said lower platen feed roll and guide means and said platen, upper platen feed roll means mounted on said frame adjacent the top of said platen cooperating with said platen for feeding a printed sheet rearwardly toward said upper hopper means, said upper platen feed roll means being manually movable from a normal feeding position closely adjacent said platen to a sheet inserting position spaced from said platen, printed sheet guide means for guiding a printed sheet with its printed side down through said narrow opening of said horizontal center wall toward said lower chamber hopper means to collate successive printed sheets in their order of printing in said lower chamber hopper means, sheet sensing means connected to said platen drive means for sensing leading and trailing edges of a sheet, bail switch means connected to said platen drive means and operable upon manual movement of said upper platen feed roll means, and selector switch means connected to said platen drive means for selecting the direction of rotation of said platen after completion of printing of a sheet, said sheet sensing means upon sensing a leading edge of an unprinted sheet from said upper hopper means together with said bail switch means upon movement of said upper platen feed roll means away from said platen operating said platen drive means before printing to rotate said platen front surface in said upward direction to move said unprinted sheet into printing position, said sheet sensing means upon sensing a trailing edge of a printed sheet together with said selector switch means upon selection of rotation of said platen front surface in said upward direction operating said platen drive means after printing to move said printed sheet upwardly and rearwardly toward said upper hopper means, and said sheet sensing means upon sensing a trailing edge of a printed sheet together with said selector switch means upon selection of rotation of said platen front surface in said downward direction operating said platen drive means after printing to move a printed sheet first upwardly to move its trailing edge upwardly above said lower platen feed roll and guide means and then downwardly for sequential stacking in said lower chamber hopper means.

* * * * *